US006198879B1

(12) United States Patent
Harris

(10) Patent No.: US 6,198,879 B1
(45) Date of Patent: Mar. 6, 2001

(54) SENSOR BLOCK AND AUTOMATIC FILL VALVE FOR WATER HEATER WITH IMMERSED COPPER FLUID COIL

(75) Inventor: Howard Harris, Ashland City, TN (US)

(73) Assignee: Howard Harris Builders, Inc., Ashland City, TN (US)

( * ) Notice: Subject to any disclaimer, the term of this patent is extended or adjusted under 35 U.S.C. 154(b) by 0 days.

(21) Appl. No.: 09/475,282

(22) Filed: Dec. 30, 1999

Related U.S. Application Data

(63) Continuation-in-part of application No. 09/333,261, filed on Jun. 15, 1999.

(51) Int. Cl.[7] ..... F24H 1/20
(52) U.S. Cl. ..... 392/451
(58) Field of Search ..... 392/496, 481, 392/449–454, 456, 447, 448; 126/344, 361, 362; 122/13.1, 13.2

(56) References Cited

U.S. PATENT DOCUMENTS

| | | | | |
|---|---|---|---|---|
| 1,560,528 | * | 11/1925 | Baum | 392/456 |
| 2,748,249 | * | 5/1956 | Collerati | 392/456 |
| 5,228,413 | * | 7/1993 | Tam | 122/17 |
| 5,438,642 | * | 8/1995 | Posen | 392/485 |
| 5,485,879 | * | 1/1996 | Lannes | 165/70 |
| 5,626,287 | * | 5/1997 | Krause et al. | 236/20 R |
| 5,838,879 | * | 11/1998 | Harris | 392/451 |

FOREIGN PATENT DOCUMENTS

| | | |
|---|---|---|
| 89 10 932 U | 12/1989 | (DE) . |
| 0 323 942 A1 | 7/1989 | (EP) . |
| 1 255 719 | 6/1961 | (FR) . |

* cited by examiner

*Primary Examiner*—Teresa Walberg
*Assistant Examiner*—Thor Campbell
(74) *Attorney, Agent, or Firm*—Shanks & Herbert

(57) ABSTRACT

A pressureless electric water heater for domestic use has a cylindrical double-walled tank for holding a quantity of a heat transfer liquid such as water. Cold water enters a copper coil immersed in the heat transfer liquid. The heat transfer liquid is heated by an electric heating element that extends down from a hinged tank top. Cold water flowing through the immersed coil is heated by the heat transfer liquid and exits the coil as hot water. The hinged top allows easy access to the interior of the tank and to the heating element, further easing access and replacement thereof. Sedimentation in the tank is minimized because the tank water is rarely replaced. Sedimentation in the coil is reduced because pressurized water flows through the coil when hot water is required and continuously cleanses the tubing. A sensor block is used to activate the heating element whenever water is introduced into the coils. An automatic fill valve maintains the tank level. A top-nesting container can hold the heating element and thermostat, allowing for easier repairs.

10 Claims, 15 Drawing Sheets

SENSOR BLOCK AND AUTOMATIC FILL VALVE FOR WATER HEATER WITH IMMERSED COPPER FLUID COIL

CROSS-REFERENCE TO RELATED APPLICATIONS

This application is related to application Ser. No. 08/579,424, filed Dec. 27, 1995, now U.S. Pat. No. 5,838,879, the disclosure of which is incorporated herein by reference, and is a continuation-in-part of Ser. No. 09/333,261 filed Jun. 15, 1999, also incorporated by reference.

BACKGROUND OF THE INVENTION

1. Technical Field

This invention relates generally to electric water heaters for domestic use. More particularly, this invention relates to a compact electric water heater for domestic uses that is pressureless and continuously self-cleaning. The water heater preferably includes one or more of an automatic fill switch, an inlet temperature sensor block and top-nesting container for mounting tile electric heating element and thermostat.

2. Background Art

The typical electric domestic water heater consists of a steel tank, insulated by fiberglass encased in a metal jacket. Cold water runs into the steel tank, is heated by lower and upper heating elements, and exits through a pipe. As hot water is drained off, cold water mixes with the remaining hot water, reducing the temperature of the remaining water.

Also, in a conventional electric water heater, minerals typically settle out from the water to form sediments, eventually reducing the heater's efficiency and causing corrosion and leaks. In addition, pressure is generated in the tightly sealed tank from heat and from occasional excessive water pressure entering the system from the cold water source. This pressure occasionally results in property damage and personal injury from steam and water leaving the pressure relief valve or from explosion from a failed valve.

The heating elements in conventional electric water heaters often fail before the tank and must be replaced. Because of the design of prior art domestic electric water heaters, replacement of the elements is a difficult task, usually requiring that the water supply be shut off and the tank drained prior to replacing the element.

Conventional electric water heaters are typically constructed of metal, a design that provides for hazardous conditions when a person comes in contact with the unit due to repairs or through casual contact. Conventional electric water heating units may also have electrical wires positioned near the metal surface, which if contacted by a frayed or loose live wire could cause electric shock and significant injury to an individual.

SUMMARY OF THE INVENTION

One object of the electric water heater of this invention is to eliminate pressure inside the tank. This is accomplished by running the pressurized cold water that is to be heated through a copper coil. The copper coil, which carries the cold water, is immersed in a pressureless tank filled with a non-recirculating heat transfer fluid such as water, however other heat transfer fluids may be used in the present invention. The water in the tank is heated by, for example, at least one electric heating element. The heated tank water heats the copper coils, which are thermally conductive. The pressurized cold water, i.e., tap water from a water supply, is heated as it circulates through the coils by thermal conductivity. Thus, cold water enters the coils, indirectly absorbs heat from the heated tank water, and exits the coils as hot water.

In the pressureless tank of this invention, new sediment is rarely added to the tank because the tank water is rarely replaced, thus reducing sediment buildup. In addition, the coil is continuously cleaned by the flow of pressurized water running through it.

Because the tank of the water heater of this invention is not pressurized, the interior of the tank can be accessed without shutting off the water supply and draining the tank. Such access is required to replace a failed element.

In a preferred embodiment of the invention, the water heater comprises a double-walled cylindrical tank formed of plastic. The spaces between the inner and outer walls of the tank and the top are insulated such as with an amount of thermal insulation, such as foam or glass fiber. Water, or another applicable heat transfer fluid, is heated in the tank by means of an electric heating element. Continuous copper coils are placed in the tank through which cold water enters and hot water exits. An optional overflow pipe, if present, the cold water inlet, and the hot water outlet are located above the water level of the tank or a second open space region existing above the water in the tank and below the tank's insulated top. This arrangement ensures that there are no holes that could develop leaks. A float valve or automatic fill valve admits tank make-up water to the tank, from the cold water inlet, when the level of water in the tank falls below a minimum tank fill level. The float valve discontinues the flow of water into the tank from the cold water inlet when the level of water in the tank reaches a full level. The heating element or a plurality of heating elements may be mounted on a heating element mount that is inserted through a hole in the tank's top. The mount extends and protrudes down into the water located in the tank. A thermostat, located on the inside of the mount, in contact with a sensor block placed within the tank, in the incoming cold water line, controls the heating element. The sensor block detects the circulation of cold water and triggers the thermostat, activating the heating element whenever water is added to the coil.

The continuously cleaned hot water heater of this invention will further provide increased hot water more efficiently in a smaller and lighter tank, while maintaining a hot water output rate that is consistent with other types of water heaters within the industry. This will reduce energy usage, material costs, shipping and storage costs.

In another embodiment of the present invention, the cylindrical tank is comprised of two walls, an inner wall and an outer wall, along with a double-walled tank top, wherein the top and the tank each have at least a single open region of space that exists between the walls. In this embodiment, the layers of thermal insulation and the particular open regions of space exist between the walls of the cylindrical tank and the walls of the top. The spaces which exist between the inner and outer walls of the tank and between the upper and lower walls of the top are insulated with an amount of thermal insulation, whose acceptable thickness may vary to give the desired insulation, leaving a volume of open space between the insulation lining the inner and outer walls. This embodiment, incorporating the plurality of open spaces lined with thermal insulation, allows for a substantial reduction in the escape of heat through thermal conductive transfer. A larger portion of heat retained by the water heater provides for greater energy efficiency. Further, the open space regions substantially prevent the atmospheric temperature from adversely affecting the internal temperature of the tank.

DESCRIPTION OF THE PREFERRED EMBODIMENT

Figure 1:
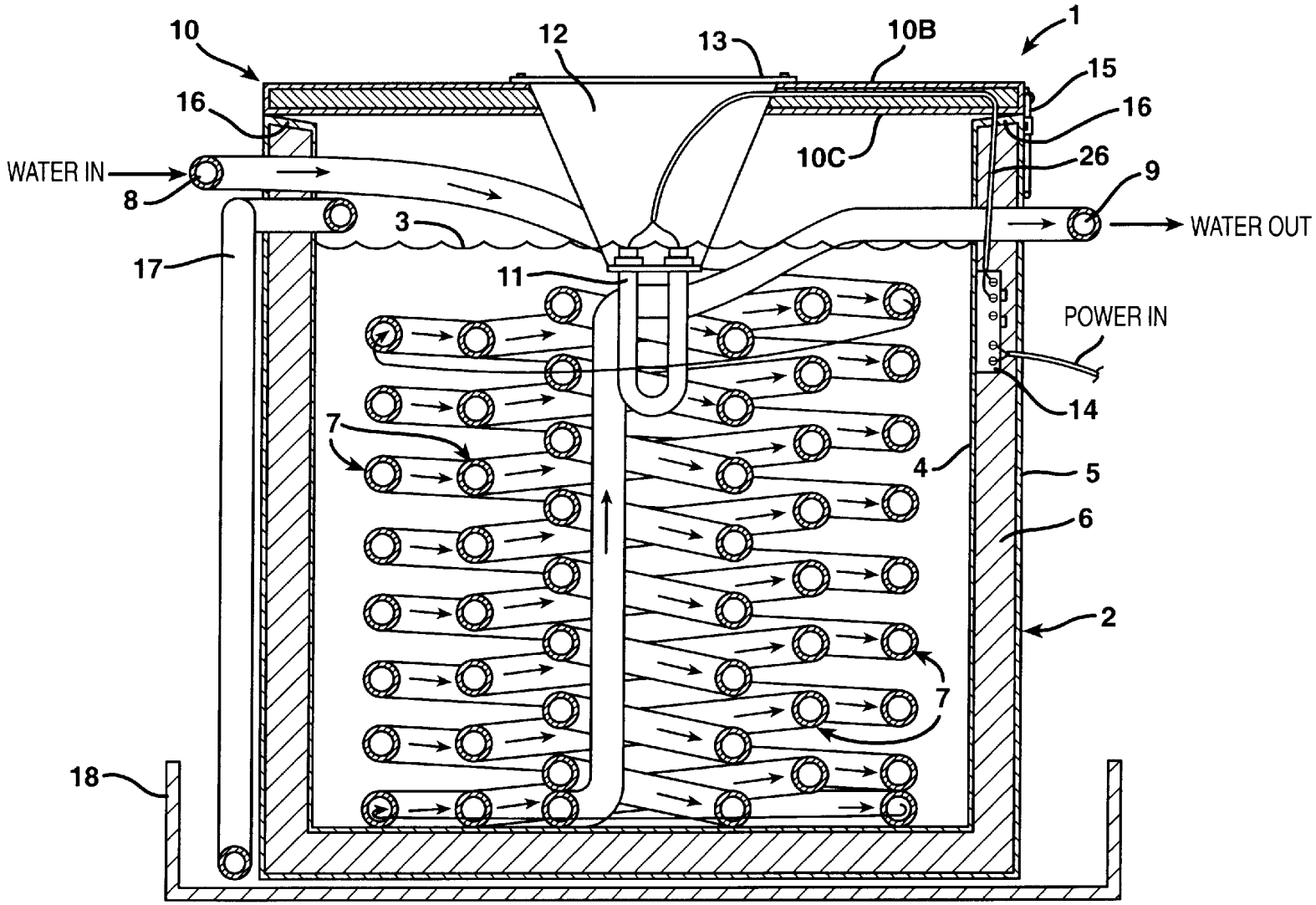
FIG. 1 is a cross sectional side view of the water heater of this invention, showing the hinged top in the closed position.

Applicant's invention will be best understood when considered in light of the following description of several embodiments of the invention as illustrated in the attached drawings wherein like reference numerals refer to like parts.

The design of the continuously cleaned pressureless water heater, generally indicated by the reference numeral (1) is shown at FIGS. 1, 3, 5, 11, 12, 13, and 14. The tank includes a vertically oriented cylindrical tank (2) containing a sufficient quantity of a heat transfer fluid (3) to cover a plurality of coils (7). Typically, the heat transfer fluid (3) will be water, but could be a different heat transfer fluid, such as DOWTHERM® or DOWFROST®. The tank (2) is preferably formed with an inner wall (4) and an outer wall (5). The inner and outer walls may be spaced about two inches apart, but any convenient spacing may be chosen. Preferably, the first open space region (5A) between inner wall (4) and outer wall (5) is filled with a thermal insulation material (6), e.g., foam thermal insulation.

Figure 2A:
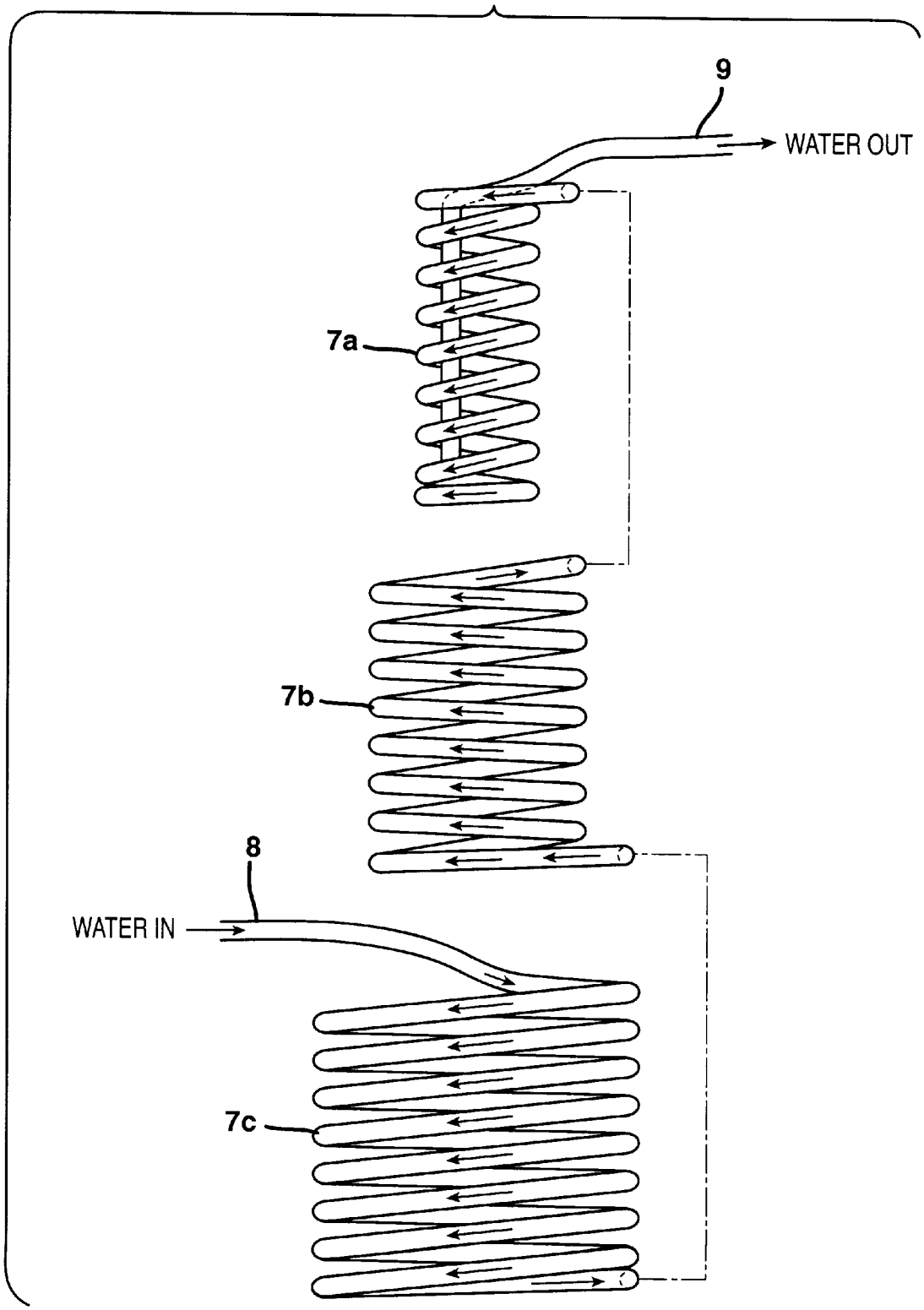
FIG. 2A is an exploded side view of the normally nested and interconnected coils used in the water heater of FIG. 1.
Figure 2B:
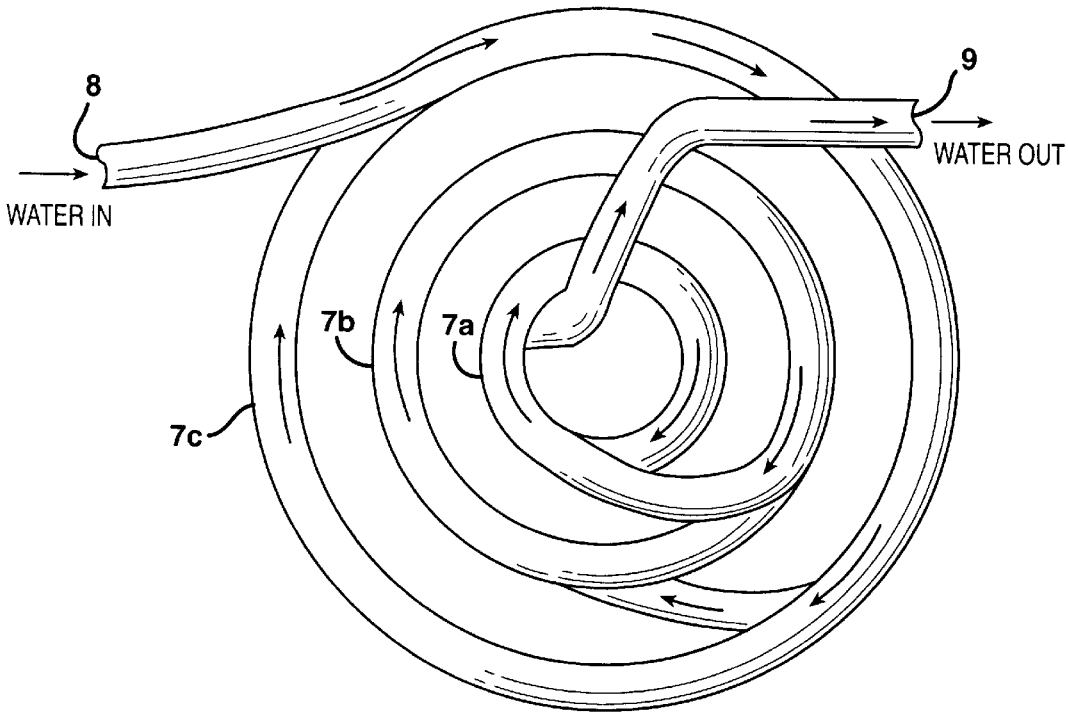
FIG. 2B is a top view of the coils shown in FIG. 2A, but in their nested and interconnected positions as shown in FIG. 1.
Figure 2C:
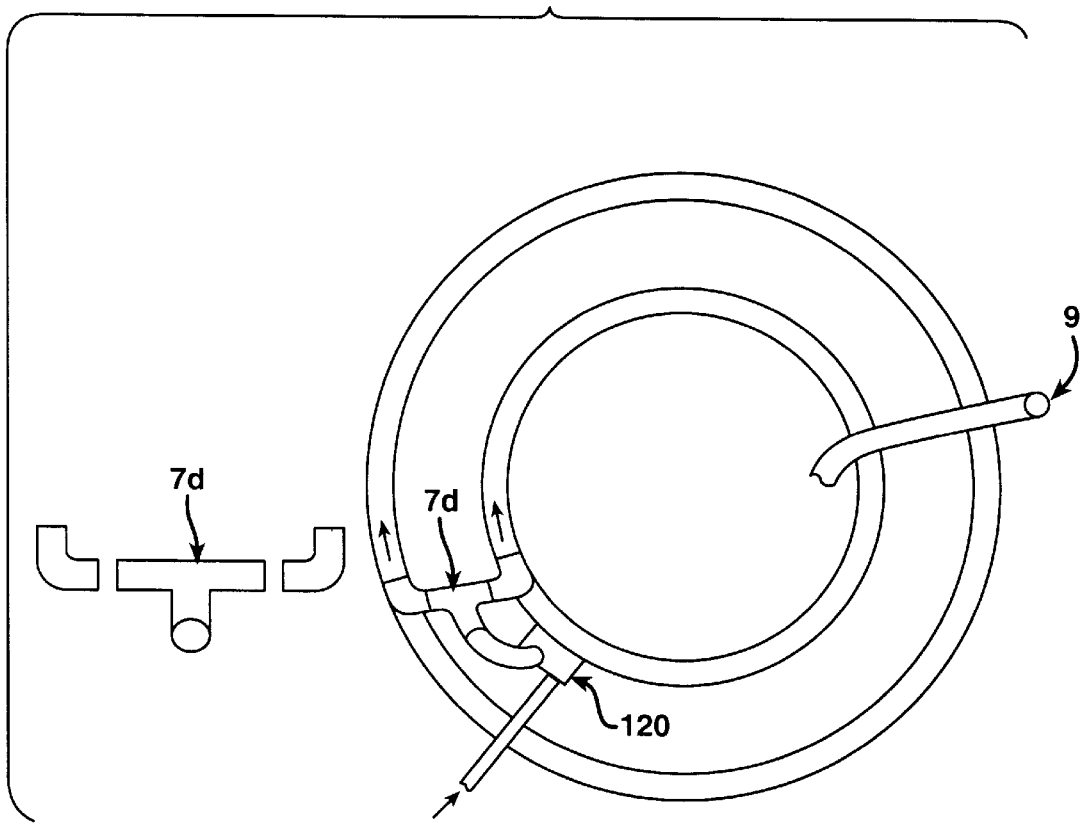
FIG. 2C is top view of a portion of the coils shown in FIG. 2A, but in their nested and interconnected positions using 90 degree and T-shaped pipe joints.
Figure 2D:
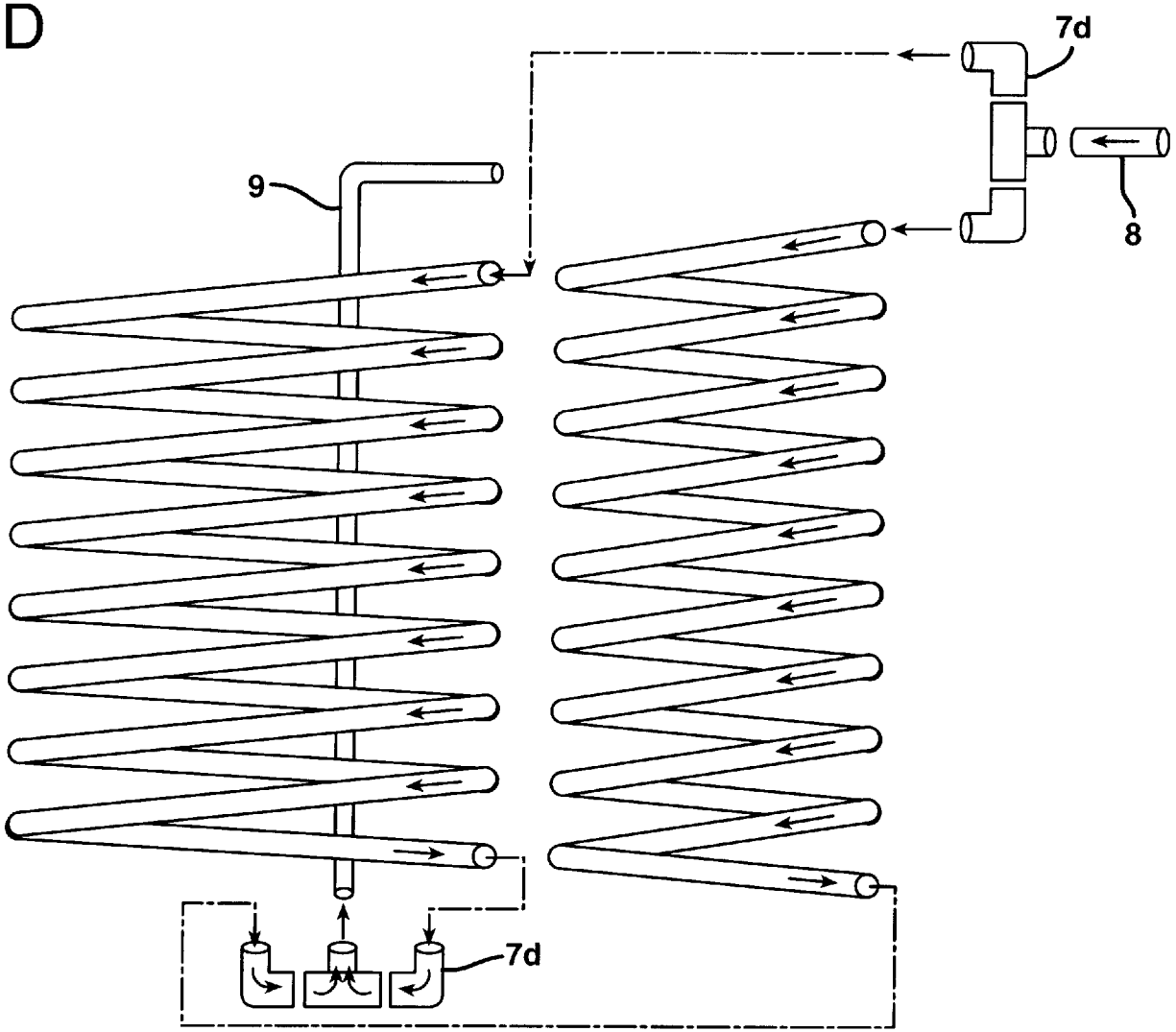
FIG. 2D is a side view of a portion of the coils showing their interconnection using 90 degree and T-shaped pipe joints.

Positioned inside the tank (2) is a coil (7) of continuously connected tubing, preferably copper tubing. The present invention may also use other types of tubing that have a high degree of efficiency, in terms of heat transfer capabilities, such as aluminum tubing or KORODENSE® CORRUGATED TUBING. The tubing that makes up the coils (7) should preferably have a wall thickness of about 0.028 inches to about 0.040 inches. As seen best in FIGS. 2A and 2B, the coil (7) is preferably formed of multiple coil sections **(7*a*), (7*b*), and (7*c*) with each coil section (7*a–c*) having a progressively increasing outside and inside diameter so that they can be nested and interconnected, as shown in FIG. 1. In a preferred embodiment, coil (7) will be formed of one-half inch outer diameter (OD) copper tubing, however, the length of the coiled tubing (7*a–c*) will vary due to the variance in heat transfer properties between materials. Some materials transfer heat in a significantly more efficient manner than others and therefore require a shorter length of tubing, such as KORODENSE® CORRUGATED TUBING. Attachments having flanges, such as fins, may be added to the coil tubing (7), forming fin tubing. The fins are constructed according to the specific diameter tubing being used and slip over the existing tubing or the fins may be formed as part of the tubing when it is created, thereby improving the heat transfer capabilities of the coil tubing (7). The use of a plurality of 90 degree and T-shaped connective joints (7*d*), having a size of about 0.25 inches to about 1 inch, allows for connection of the coils to the water inlet (8), the water outlet (9), and to the other nested coils (7*a–c*) (seen in FIGS. 2C and 2D). These connective joints (7*d*) reduce the water down in each coil to about one-half its previous volume as the water is divided between two coils. The water then circulates through the coils to the bottom of the tank and the divided amounts of water are recombined into single line where the coils have been connected to the water outlet (9) using the 90 degree and T-shaped connective joints (7*d*). The cold water to be heated inside the tank (2) enters the coil (7) at a cold water inlet (8), circulates through each coil section (7*a–c*) successively, and exits the coil through the hot water outlet (9). The direction of water flow is indicated by directional arrows into the water inlet (8), along the outer surface of the coil (7) and out of the water outlet (9)**.

Figure 9:
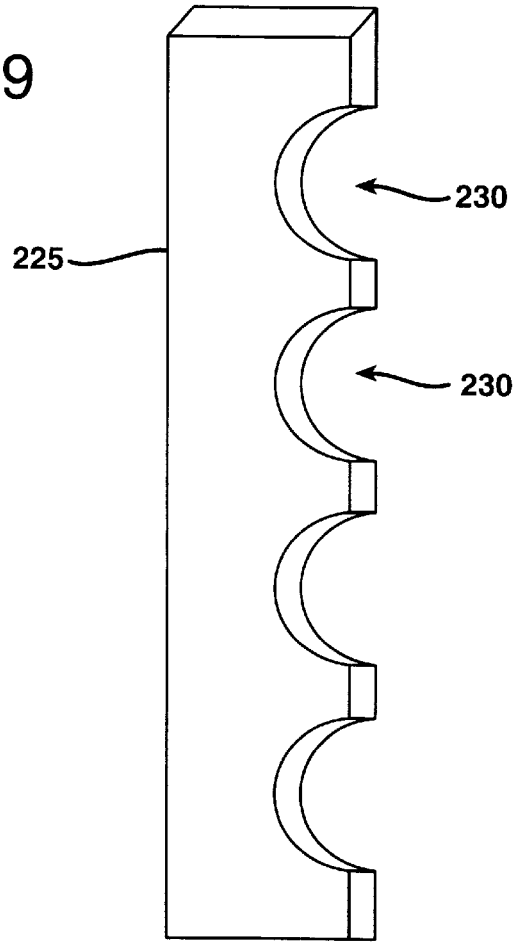
FIG. 9 is a view of coil spacers used to vertically separate adjacent portions of the coil.

Coil clips or spacers (225) may be used to maintain the even spacing of the coil of tubing. As shown in FIG. 9, the coil clips or spacers are formed from long narrow strips of packing material such as Styrofoam® brand multicellular expanded synthetic resin or a non-corrosive supportive material such as plastic, having circular indents (230) along one edge of the material to hold the tubing in place. Preferably, three coil spacers support each coil section.

In FIGS. 1, 3, 11 and 12, preferably, a double-walled top (10), is constructed of plastic, which is then insulated, and supports at least a single conventional electric heating element (11), which is secured to the top (10). A first plurality of gaskets (16) are used in order to ensure a proper seal between the top (10) and the tank (2) to prevent a loss of heat. The electric heating element (11) extends downward inside the tank (2) and beneath the surface of the tank water (3). The heating element (11) could be any conventional electric water heater element, for example, a Camco Electric Water Heater Element #02363. At least a single heating element (11) may be attached to a conical plastic mount (12), extending downward through the top (10), which may be fastened to the top (10) by a plate (13) capable of being attached to the top (10) using fastening devices such as screws. A thermostat (14), also of conventional design, such as a Camco Electric Water Heater Thermostat #07845, can be electrically connected by a control wire (26) which runs upwardly between the inner wall (4) and the outer wall (5) of the tank (2) and across the walls of the top (10). The thermostat controls the electric power supplied to the heating element (11) thereby regulating the temperature of the tank water (3).

In accordance with another embodiment of the invention, the water heating unit as shown in FIGS. 1, 3, 11, and 12 further includes a first plurality of gaskets (16) in order to ensure a proper seal between the top (10) and the tank (2) to prevent a loss of heat.

Figure 5:
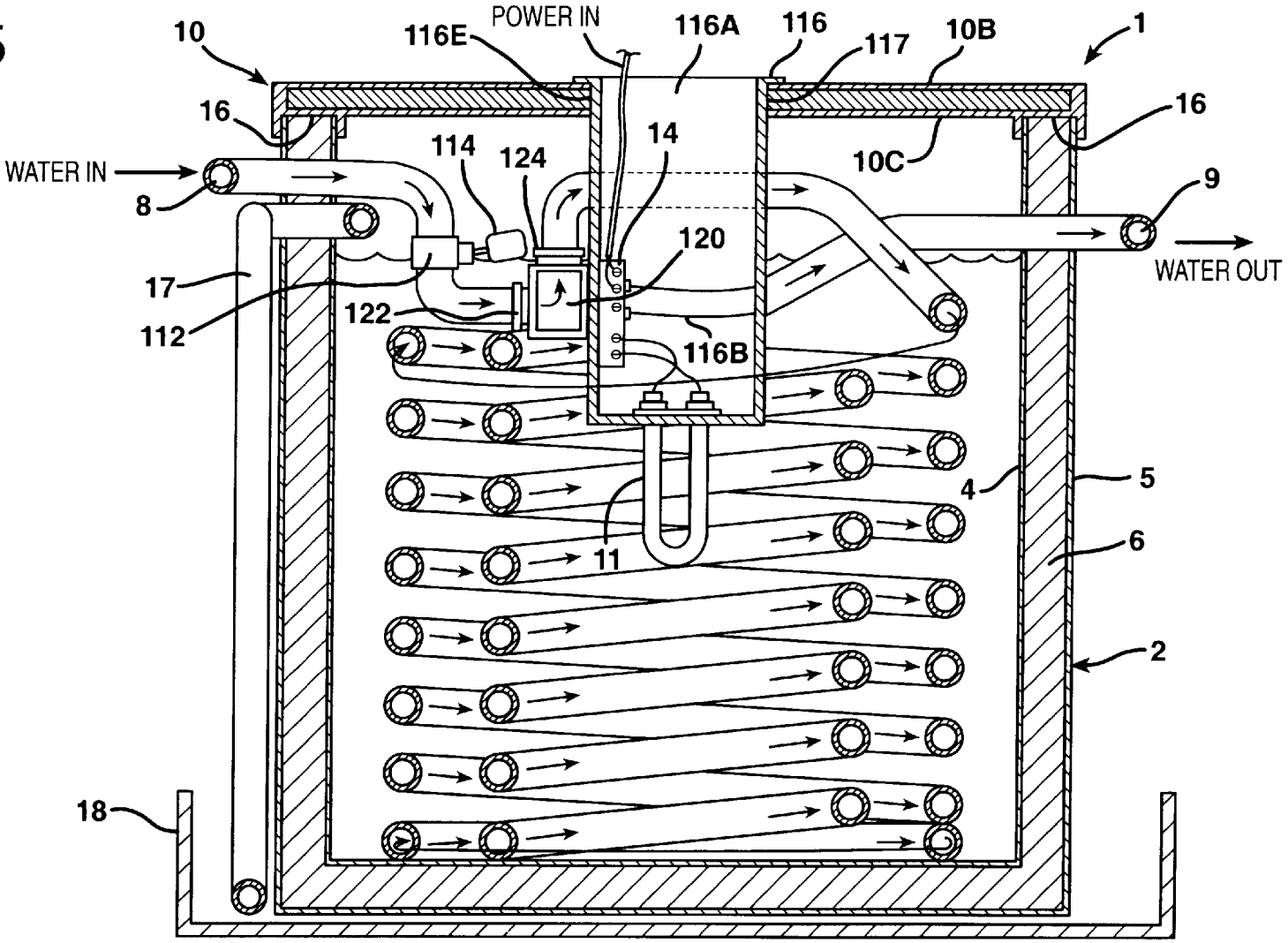
FIG. 5 is a cross sectional side view of the water heater according to another embodiment of this invention.
Figure 13:
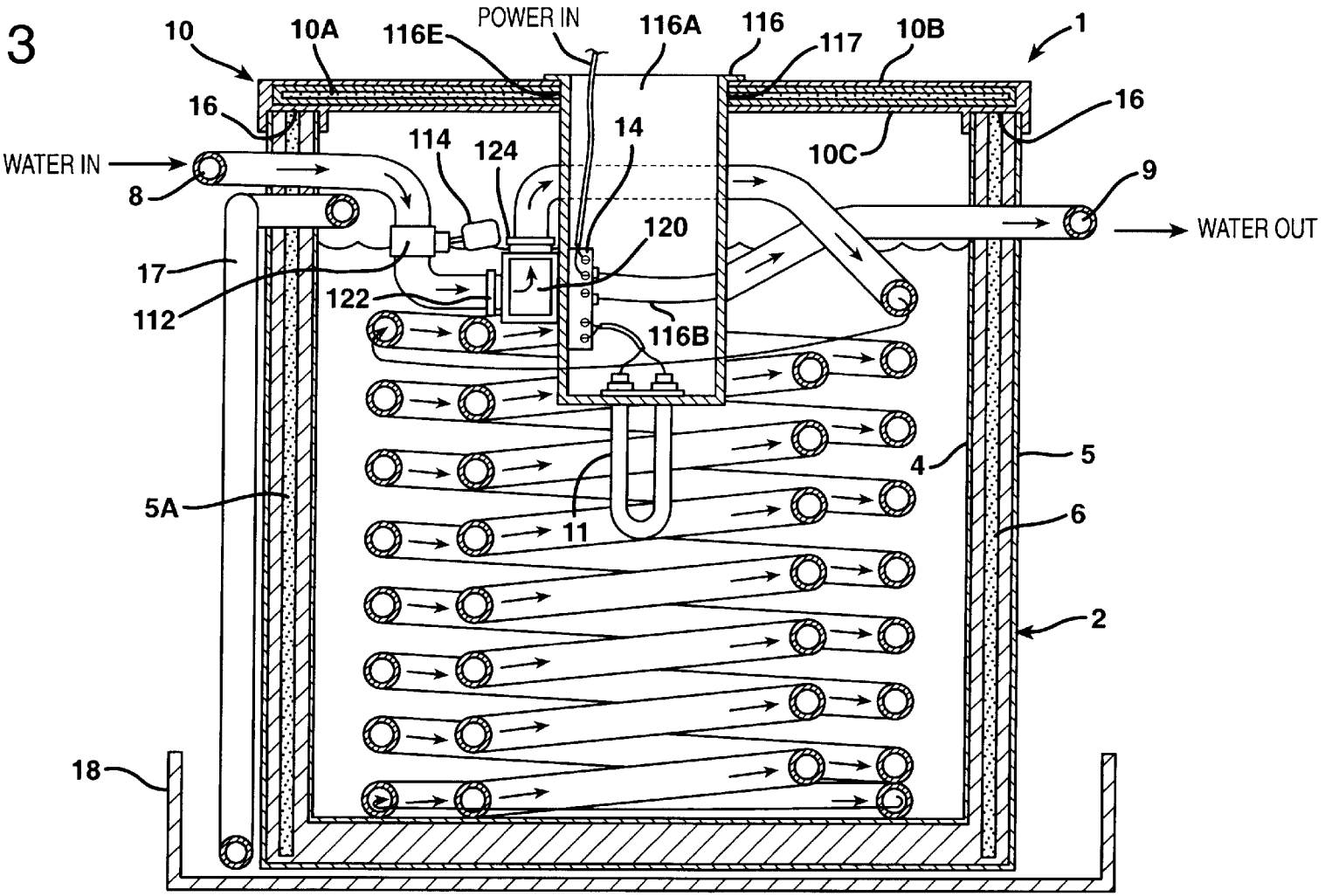
FIG. 13 is a cross sectional side view of the water heater supporting an electric heating element that is secured to a heating element mount and having the open air space regions between the tank's inner wall and outer wall and the top's upper wall and lower wall.
Figure 14:
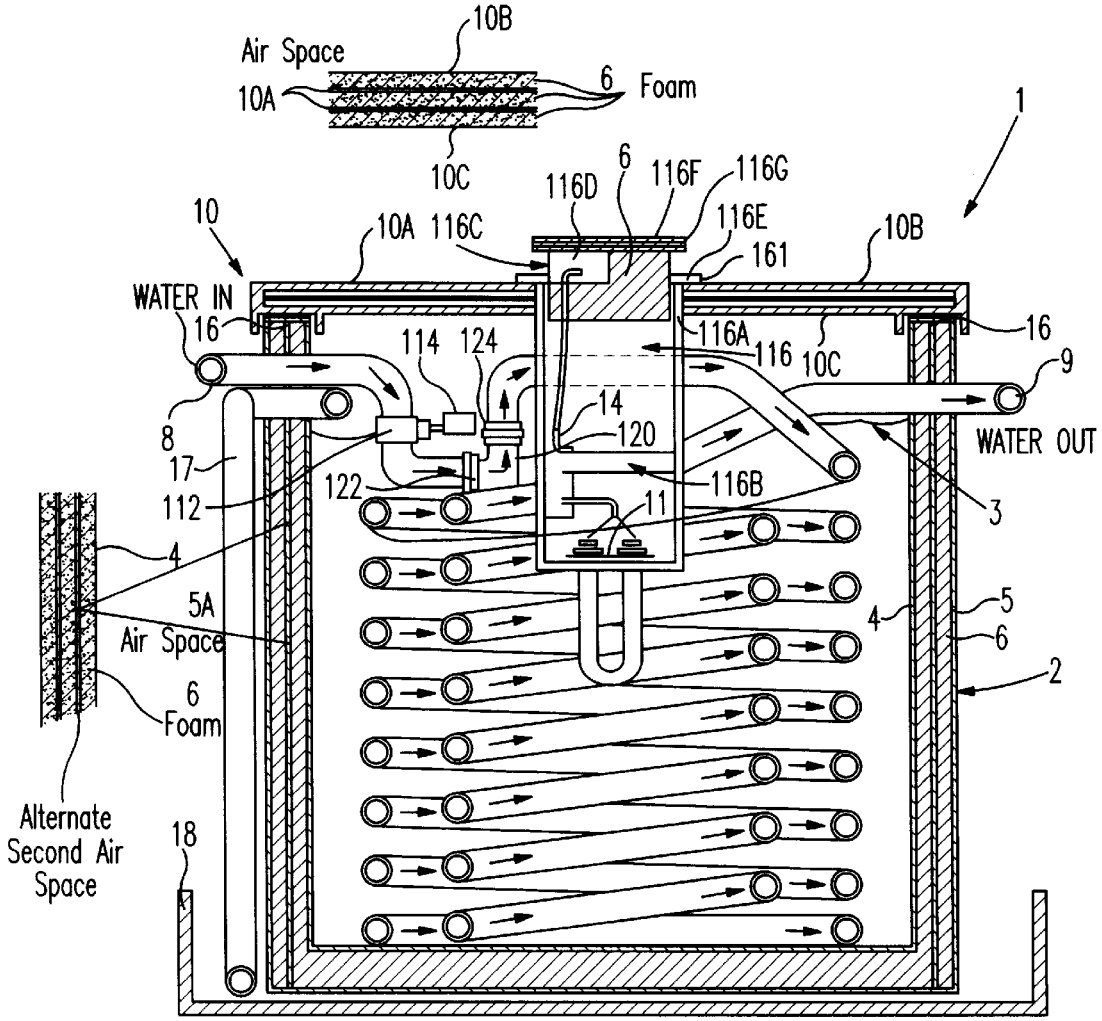
FIG. 14 is a vertical cross sectional view of another embodiment of the water heating unit of FIG. 13, including multiple open space regions.
Figure 15:
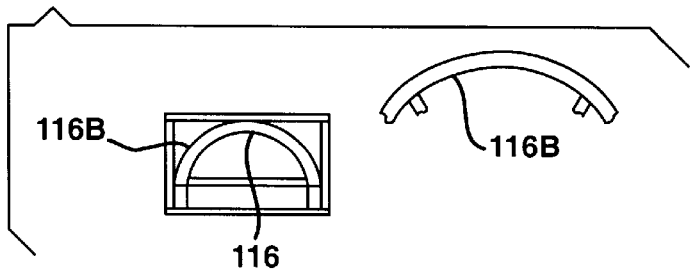
FIG. 15 is a depiction of the flexible clip used to position the thermostat within the heating element mount.
Figure 16:
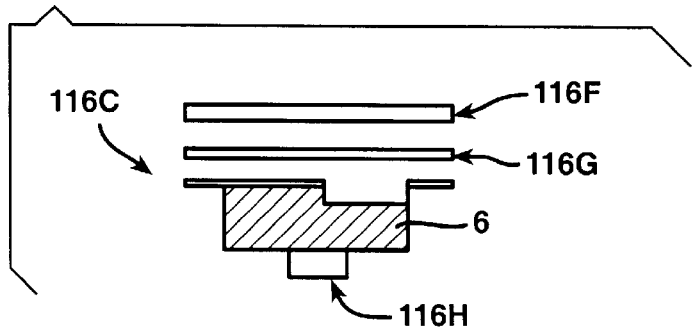
FIG. 16 is a side view of the insulated insert containing an electrical wiring box.
Figure 17:
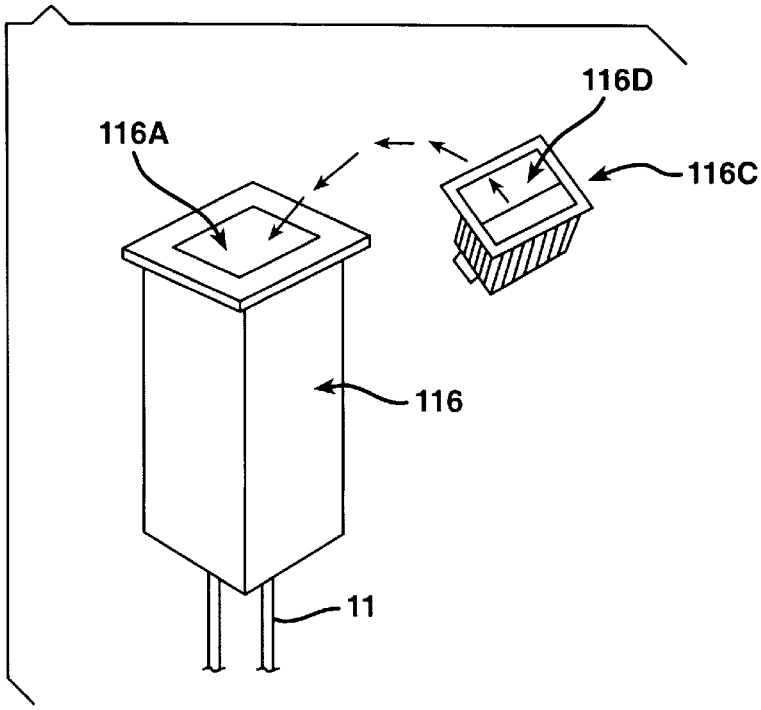
FIG. 17 is a top view of the insert, showing the placement into the opening of the heating element mount.

Alternatively, as shown in FIGS. 5, 13, or 14, a double-walled top (10), preferably constructed of plastic, which is then insulated, supports at least a single conventional electric heating element (11) that is secured to a heating element mount (116), having an opening (116A), and extends downward inside the tank (2) and beneath the surface of the tank water (3). The mount (116) is inserted through a center hole (117) in top (10), and may be held in place by a lip that is larger than the center hole (117) with a proper seal formed between the center hole (117) and the mount (116) using a second gasket (116E). A thermostat (14), also of conventional design, can be mounted on one side of the heating element mount (116), in thermal proximity to a sensor block (120) in the coil line. The thermostat (14) controls electric power to the heating element (11) for regulation of the temperature of the tank water (3). The thermostat (14) can be held in place by a flexible clip (116B) that has the capability to be bowed, thereby securing the position of the thermostat inside the heating element mount (116). An insert (116C), as shown in FIG.16 and FIG. 17, constructed of a plastic material or its equivalent, is designed to be insulated and contains an electrical wiring box (116D) which provides for an electrical connection between a power supply and the thermostat. The insert (116C) is placed into the opening (116A) of the heating element mount (116). In addition, a third gasket (116G) resides where the insert (116C) contacts the electric heating mount (116) in order to ensure a proper seal between the elements.

Figure 3:
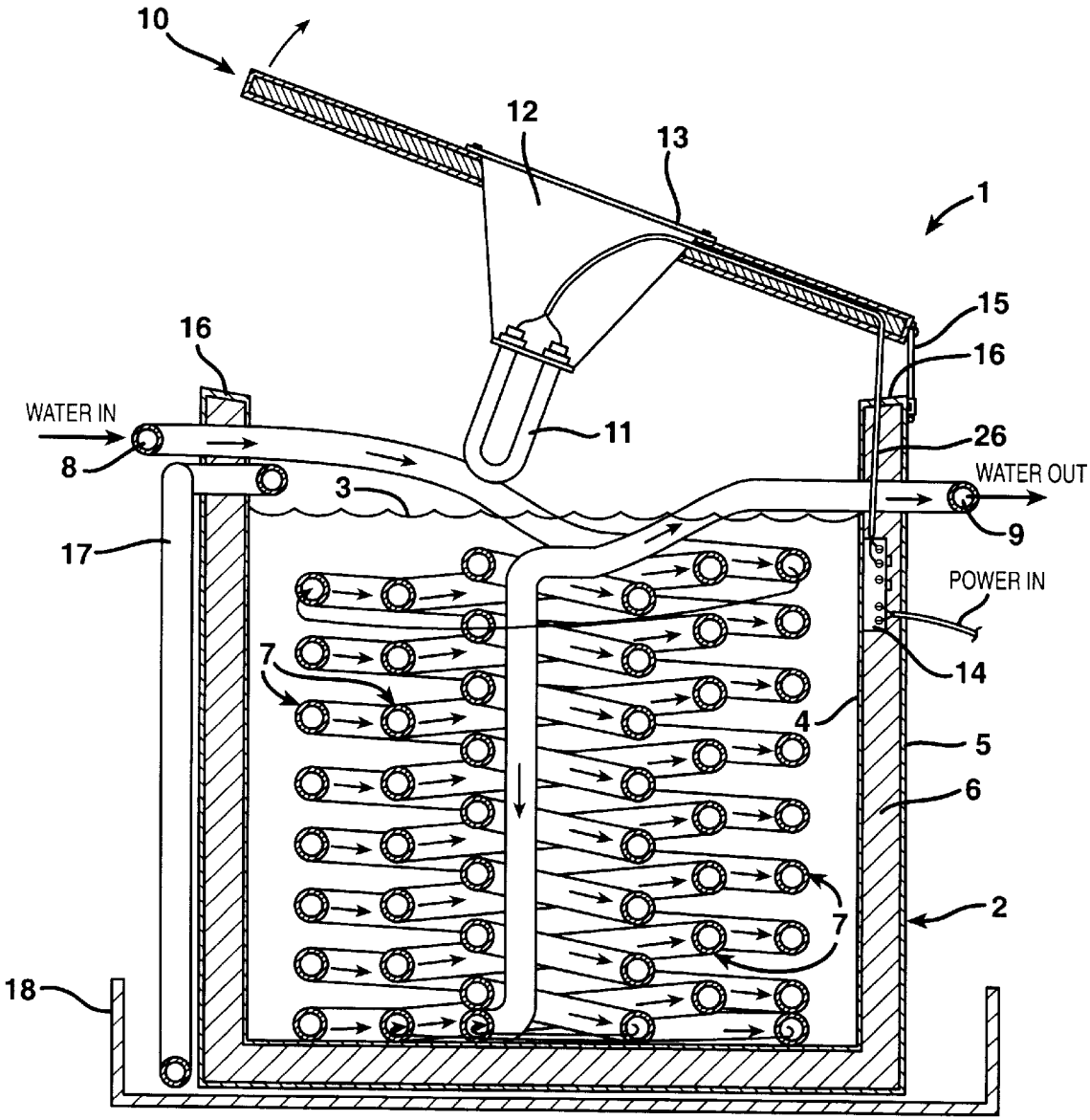
FIG. 3 is a cross sectional side view of the water heater of FIG. 1, showing the hinged top in the open position.
Figure 4:
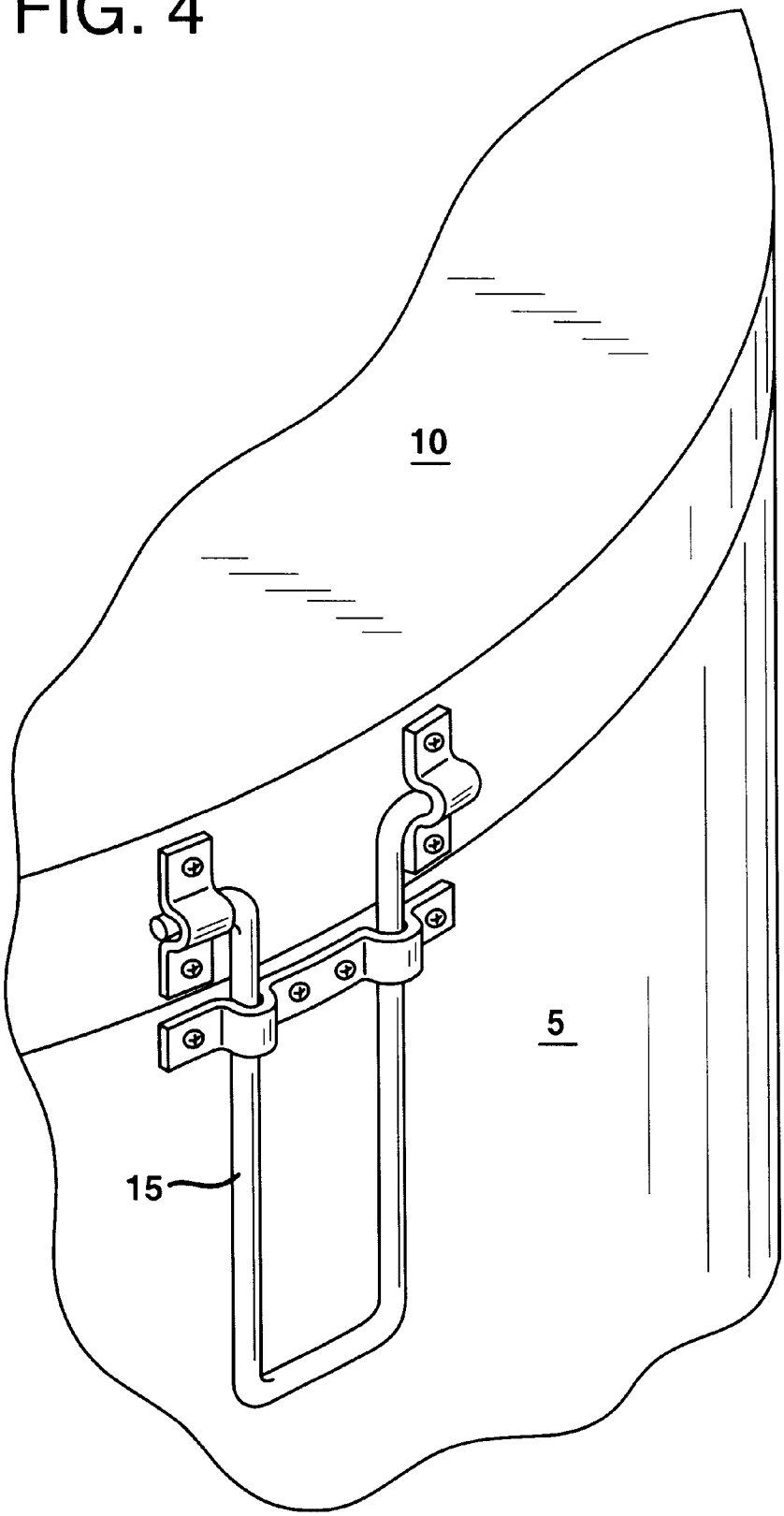
FIG. 4 is an enlarged perspective view of a section of the tank side wall and top of the water heater of FIG. 1, showing the connecting hinge.
Figure 11:
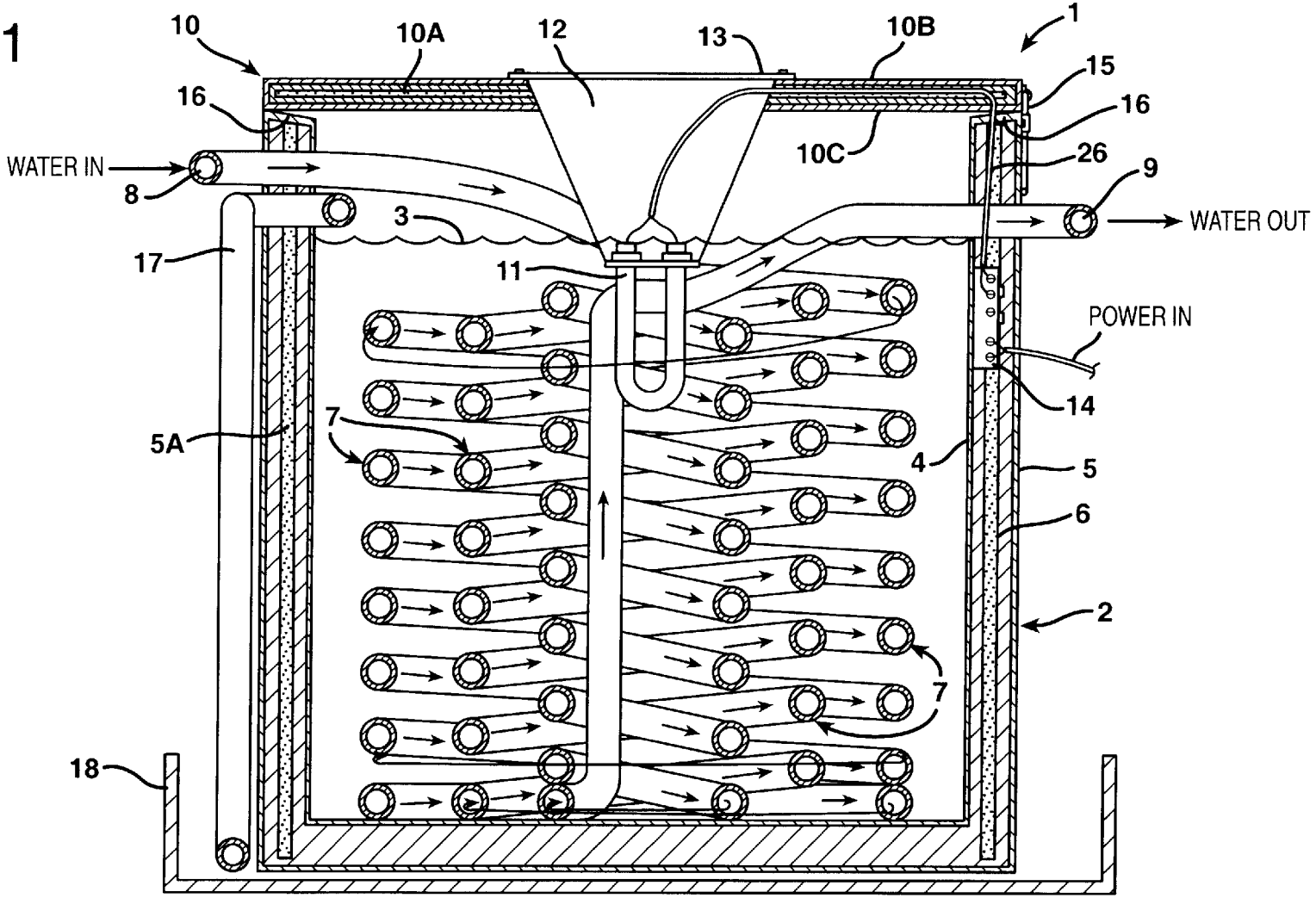
FIG. 11 is a cross sectional side view of a second water heater of this invention, showing the hinged top in the closed position and having the open air space regions between the tank's inner wall and outer wall and the top's upper wall and lower wall.
Figure 12:
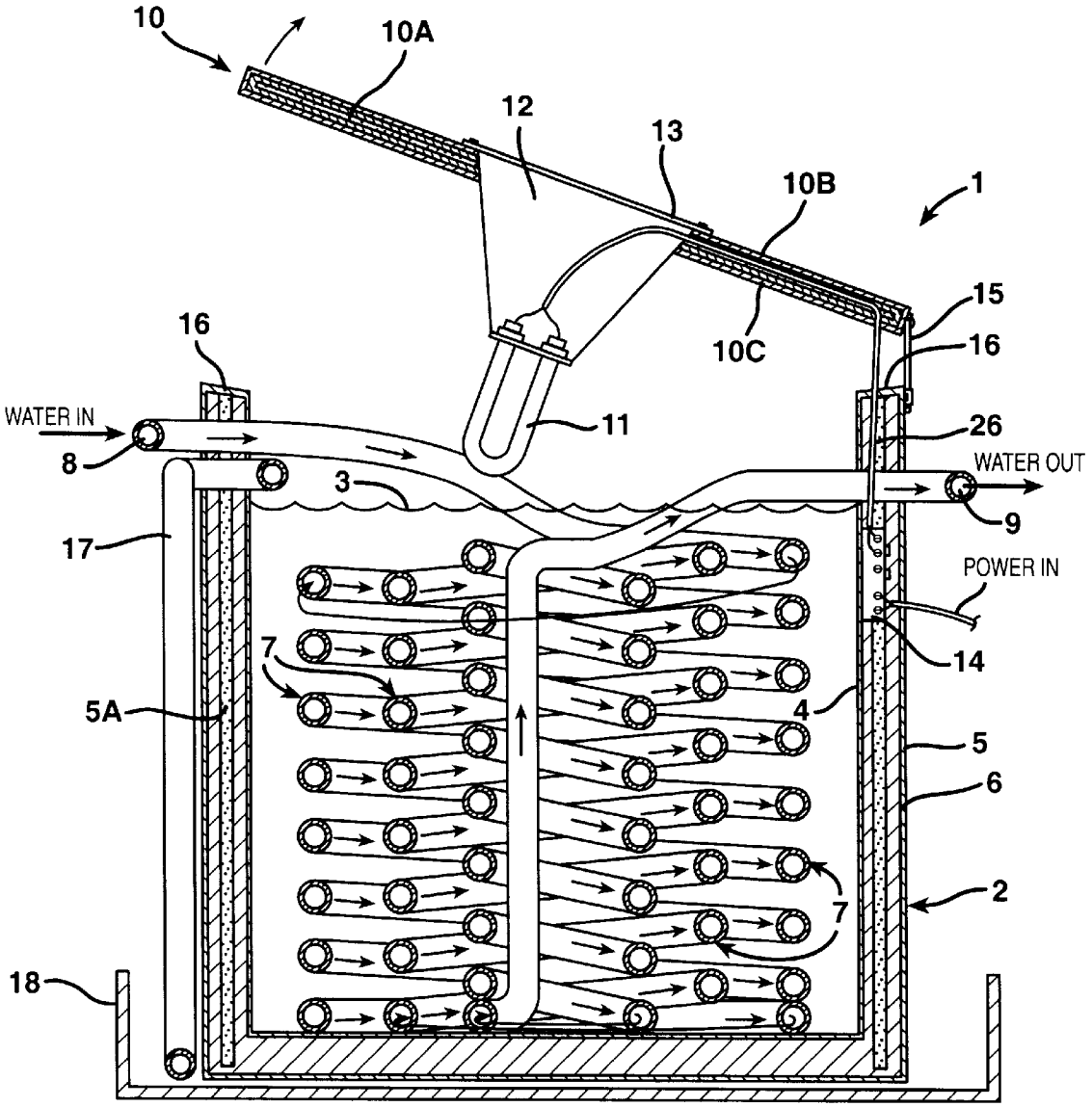
FIG. 12 is a cross sectional side view of the water heater of FIG. 11, showing the hinged top in the open position.

In accordance with another aspect of the invention, the top (10) may be attached to the tank (2) on one side by a hinge (15) so that the top (10) can be separated from the tank outer wall (5) by moving it from a closed position, as shown in FIG. 1 and FIG. 11, to an open position, as shown in FIG. 3 and FIG. 12. When the top (10) is in the open position, the heating element (11) can be easily accessed and replaced without having to shut-off the water supply or drain the tank (2). Almost any conventional type of hinge can be used, with one example shown in FIG. 4 in which the hinge (15) allows for both vertical and pivoting separation of the top (10) from the tank outer wall (5).

In accordance with another aspect of the invention as shown in FIGS. 5, 13, or 14, a water heater (1) has a top (10) that includes a center hole (117). A heating element mount (116) descends through the center hole (117) into the tank water, preferably positioning the heating element (11) at approximately the center of the tank. A plastic lid (116F) covering the insert (116C), electrical wiring box (116D), and second gasket (116E), is preferably insulated and used to cover the hole to limit heat loss through the center hole (117). A thermostat (14) is preferably attached in close thermal contact with an inner wall of the mount (116). The thermostat (14) can be held at the correct depth within the mount (116) using a depth extension holder (116H) in order to position the thermostat, and therefore the sensor block (120), at least 2 inches below the water line within the tank (2). The outer wall of the container fits tightly against a sensor block (120). The coil (7) is attached to a sensor block (120) that receives the first influx of cold water. Because of the thermostat's position against the sensor block (120), the heating element (11) will begin heating, raising the water temperature in the tank while water is being extracted from the coils (7). Timing the heating to coincide with use raises the efficiency of the water heater.

As shown in FIGS. 5, 13 and 14, the top (10) can simply rest on top of inner wall (4) and outer wall (5) of the tank (2). Preferably, the top (10) is fastened to the tank (2) using any conventional type of fastening device which allows for removal of the top (10), including but not limited to, screwing the top (10) onto the tank (2) using one or two pairs of mating threads (not shown) on the top (10) and the inner wall (4) and/or outer wall (5), clamps or latches. A first plurality of gaskets (16) are used to ensure a proper seal between the top (10) and the tank (2) to prevent any significant loss of heat.

Figure 6:
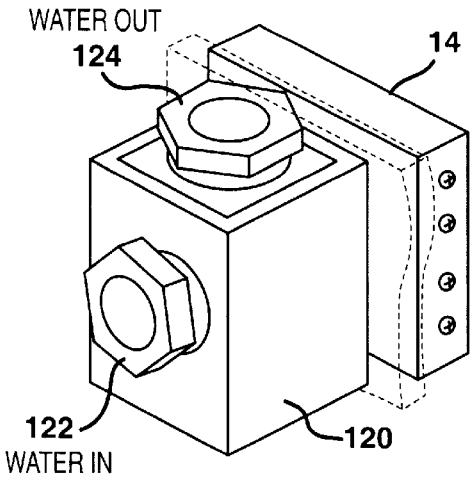
FIG. 6 is a perspective view of a first sensor block configuration.
Figure 7:
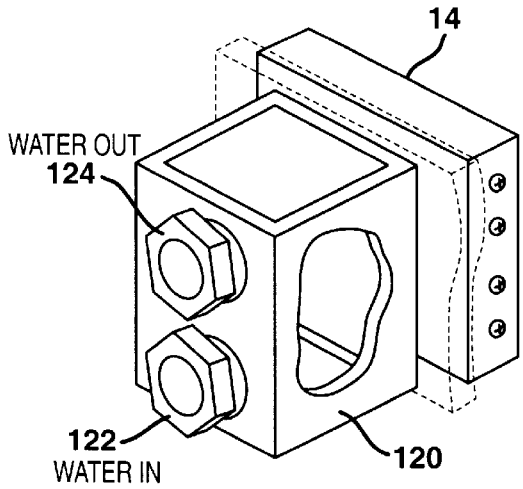
FIG. 7 is a perspective view of a second sensor block configuration.
Figure 8:
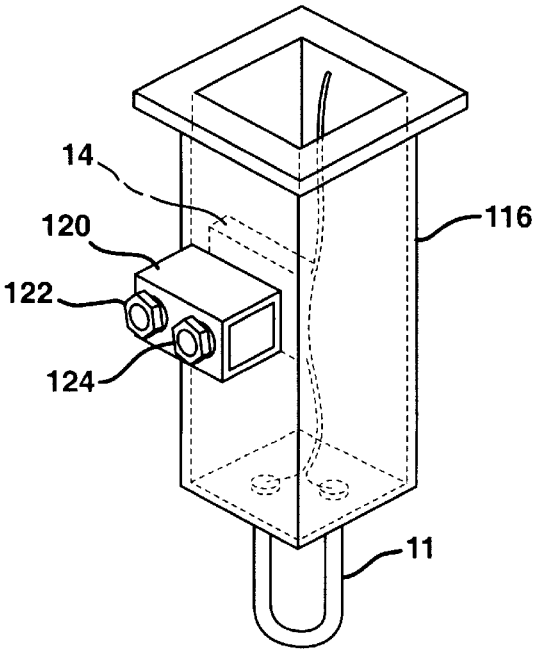
FIG. 8 is a perspective view of the heating element mount, a third sensor block configuration, and thermostat.

The sensor block (120) is a hollow block through which the incoming cold water flows before passing through the coiled section. The sensor block (120) is placed in close proximity with the thermostat (14). The sensor block should preferably be perfectly aligned with the thermostat to improve the thermal contact between the devices. As hot water is drawn, cold water circulates through the in-line sensor block (120), thereby cooling the thermostat (14). The sensor block (120) could be configured in various ways to allow the flow of water as shown in FIGS. 6–8. In particular, the connectors (122) and (124) for bringing water through the sensor block (120) may be positioned on different faces of the sensor block (120) as shown in FIG. 6, on the same face positioned vertically as shown in FIG. 7 or horizontally as shown in FIG. 8. The sensor block (120) preferably is made of any thermoconductive metal. The thermostat (14) is held tightly fitted by the mount (116) against sensor block (120). A tension plate would preferably be used to hold the sensor against the center block.

Figure 10:
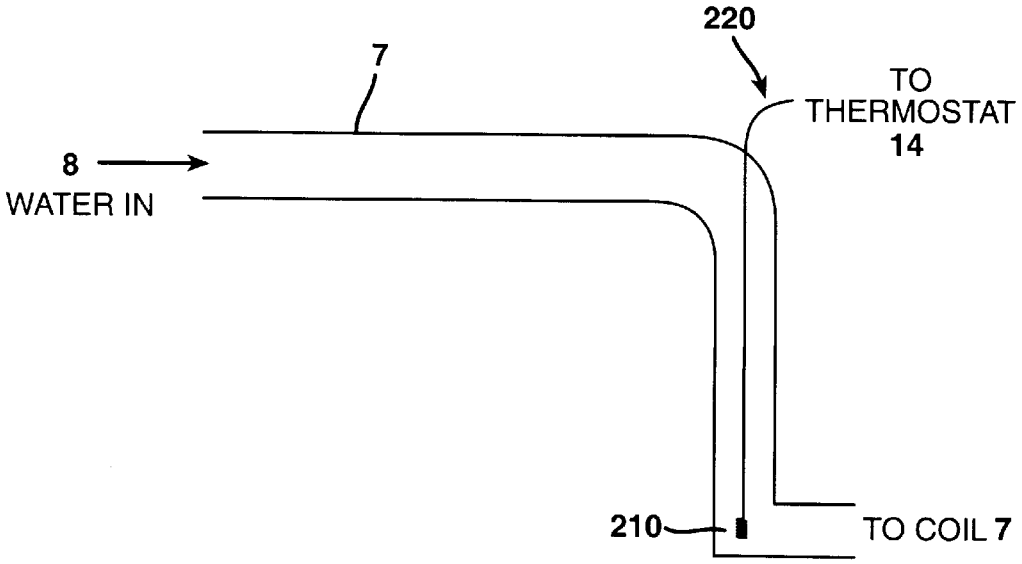
FIG. 10 is a view of a temperature sensor, where a thermocouple is placed inside the tubing near the cold water intake.

In accordance with another aspect of the invention, as shown in FIG. 10, a temperature sensor (210), e.g., a thermocouple, is placed inside the coil tubing (7) near the cold water inlet (8). A wire (220) passing through the tubing, preferably at a point above the level of fluid in the tank, connects the temperature sensor (210) to the thermostat (14). In this embodiment, the thermostat could be mounted in the heating element mount, between the inner and outer wall, or at some other convenient place. When the temperature of the water in the coil drops below a predetermined temperature, for example 140° F., the thermostat activates the electric heating element, thereby heating the water in the tank.

As shown in FIGS. 5, 13, and 14 a float (114) is attached to the incoming cold water line (8). The float measures the water level in the tank and fills the tank through valve (112) automatically when the water level in the tank falls below the necessary level. In a preferred embodiment, the float valve is attached to an in-line T-shaped connective joint.

However, due to displacement of water by the heating element mount, the automatic fill valve or float valve must be turned-off when the heating element mount is removed to prevent overfilling of the water tank thereby causing unnecessary overflow when the heating element mount is replaced in the water heating unit.

FIG. 5 shows a heating element mount (116) in accordance with one embodiment of the invention, including water heater, sensor block (120), connectors (122) and (124) and thermostat (14). Access to the heating element (11) and thermostat (14), for replacement or repair, is simplified by placing the thermostat (14) inside the mount (116) and heating element (11) on the mount (116). The top (10) in this embodiment can be left in place when repairs are necessary, leaving the water supply connections undisturbed.

As seen in FIGS. 1, 3, 5, 11, 12, 13 and 14 an optional overflow pipe (17) may be located above the water level of the tank or the second open space region which is located between the top surface of the tank water (3) and the top (10). The overflow pipe extends horizontally through the second open space region and through the inner and outer walls of the tank and then vertically downward along the outer wall of the tank. The overflow pipe (17), if present, runs to an overflow pan (18) in which the water heater (1) sits.

In one test performed, using less efficient materials than those described, twenty gallons of cold tap water (temperature not measured) were placed in the tank (2). The coil (7) consisted of 300 feet of one-half inch OD copper tubing. The thermostat (14) was set at 150 degrees. The tank water (3) was heated with one 4500-watt heating element (11). The water was preheated for forty-five minutes. Forty gallons of water was then continuously drawn from the heater (1) with results as follows:

1. First five gallons—140 degrees
2. Second five gallons—125 degrees
3. Third five gallons—120 degrees
4. Fourth five gallons—115 degrees
5. Fifth five gallons—110 degrees
6. Sixth five gallons—105 degrees
7. Seventh five gallons 102 degrees
8. Eighth five gallons—98 degrees (3¼ Kilowatts Were Used)

The above-described test was conducted primarily to show that the present invention could thermoconductively heat a quantity of water. The test further shows that the water heater unit of the present invention, using a pressureless configuration, further using thermoconductive coils and a plastic top and tank, can achieve a hot water output amount comparable to a conventional water heating unit under high pressure.

The following descriptions of other embodiments of the invention, as illustrated in the attached drawings, include elements that correspond to elements previously described, wherein like reference numerals refer to like parts.

In another embodiment of the present invention, open regions of space are incorporated to further improve the efficiency and energy saving capabilities of the water heater unit. Additionally, the tank (2) and the top (10) may each contain multiple open space regions separated by thermal insulation (6), thereby further increasing the efficiency of the water heating unit (1). Conventional electric water heating units do not incorporate a design, which is an embodiment of the present invention, utilizing double walled construction of the plastic tank (2). The improved design enables any leaking of the inner tank wall (4) to be controlled by the outer tank wall (5), thereby preventing the unit from causing water damage to the surrounding areas. In addition, the design of the present invention, using plastic instead of metallic materials, prevents conduction of electrical current, therefore, it is a safer electric water heating unit than conventional models.

The design of the continuously cleaned pressureless water heater with a plurality of open space regions, generally indicated by the reference numeral (1) is shown in FIGS. 11, 12, 13, and 14. The tank includes a vertically oriented cylindrical tank (2) containing a sufficient quantity of a heat transfer fluid (3) to cover a plurality of coils (7). Typically, the heat transfer fluid (3) will be water, however other heat transfer fluids may be used such as DOWTHERM® or DOWFROST®. In addition, the inner wall (4) and outer wall (5) of the tank, along with the upper wall (10B) and lower wall (10C) of the tank top are typically constructed of a plastic material, however other equivalent materials may be used for construction. The inner wall (4) and the outer wall (5) of the tank (2) may be spaced apart using any convenient spacing distance, taking into account at least a first open space region (5A) which exists between the inner wall (4) and the outer wall (5). A greater thickness of the lining of insulation results in greater efficiency of the water heater, in that, tank walls spaced 4 inches apart results in a water heater of greater efficiency than one with tank walls spaced only 2 inches apart because of the greater width of the breakage in thermal contact. Preferably, the first open space region (SA) between inner wall (4) and outer wall (5) is fractionally filled with a thermal insulation material (6), e.g., foam thermal insulation, in order to form a lining on at least one wall's surface. The lining on a wall may have a thickness of about 0.25 inches to about 3 inches, but should preferably have a thickness of about 1 inch. The distance across the first open space region (5A), measured along a line perpendicular to the foam lining on each wall should have a distance of at least about 0.0125 inches between the linings of insulation or between a lining of insulation and a tank wall in order to sufficiently cause a breakage in thermal contact. However, the distance across the first open space region (5A) preferably measures about 0.25 inches to about 0.50 inches.

In another embodiment of the present invention, the top (10) also includes at least a single open region of space. FIGS. 11, 12,13, and 14 depict a double-walled top (10), having an upper wall (10B) and a lower wall (10C), with a third open space region (10A) existing between the walls. An amount of thermal insulation (6), such as fiberglass, is introduced to the third open space region (10A) in order to form a lining on at least one wall's surface. The lining on a wall may have a thickness of about 0.25 inches to about 3 inches, but should preferably have a thickness of about 1 inch such that the distance across the third open space region (10A), when measured along a line, perpendicular or any other suitable direction, to the lining on each wall, should have a distance of at least about 0.0125 inches between the linings of insulation or between a lining of insulation and a tank wall in order to sufficiently cause a breakage in thermal contact. However, the distance across the third open space region (10A) preferably measures about 0.25 inches to about 0.50 inches.

This top (10) is configured so that it can receive and support at least a single conventional electric water heater element (11) or may accommodate at least a single conventional electric heating element (11) that is secured to a heating element mount (116) inserted through a center hole (117) in the top (10).

The cylindrical tank (1) and the top (10), each of which contain at least a single open space region, are designed to accommodate all of the elements designed to be accommodated by the preferred embodiment.

Thus, although there have been described particular embodiments of the present invention of a new and useful water heater, it is not intended that such references be construed as limitations upon the scope of this invention.

I claim:

1. An electric water heater comprising:

a. a water tank including a tank wall having an inner portion and an outer portion separated by at least a single first open space region filled with thermal insulation such that there is a first open space region between said inner portion and said outer portion of said water tank wall, a tank bottom, and a tank top, said tank top adapted to be separated from said tank wall, said water tank adapted to hold a quantity of non-pressurized and non-circulating heat transfer liquid up to an upper liquid level that is below said tank top and defining a second open space region inside said tank between the upper liquid level and said tank top;

b. a plurality of thermally conductive coils mounted inside said tank and having a water inlet portion and a water outlet portion that each extend outwardly through said first open space region and through said tank wall, whereby said tank top can be separated from said tank wall and said water inlet portion and said water outlet portion;

c. an heating element or a plurality of heating elements attached to said tank top and extending downwardly through said second open space region in said tank top and below the upper liquid level;

d. a sensor block receiving water from said coil and returning water to said coil;

e. a thermostat connected to said tank top, wherein said thermostat is in thermal proximity with said sensor block such that it activates said heating element when the water temperature in said sensor block changes; and f. wherein said heating element contacts and heats the heat transfer liquid inside the tank and said heat transfer liquid contacts said coil to heat water from a water supply that enters said water inlet portion and circulates through said coil such that heated water leaves said water outlet and returns to the water supply.

2. The water heater according to claim 1, wherein said tank top is a double walled top having an upper wall portion and a lower wall portion separated by at least a single third open space region fractionally filled with thermal insulation such that there is a third open space region between said upper wall portion and said lower wall portion of said tank top.

3. The water heater according to claim 1, wherein said thermostat is located inside a heating element mount having an opening and is further positioned in thermal proximity with said sensor block by using a flexible clip and a depth extension holder.

4. The water heater of claim 1, wherein said tank top includes a center hole that can receive a heating element mount, having a second gasket between the center hole and the mount providing sealing, attached to said heating element and said thermostat, said mount having said opening capable of receiving an insert containing an electrical wiring box which provides for an electrical connection of a control wire to said thermostat which then connects to said heating element, a third gasket providing for proper sealing between said insert and said mouth, and a plastic lid covering said insert providing a thermal barrier.

5. The water heater according to claim 1, wherein said first open space contains a quantity of thermal insulation such that it forms a lining, having a thickness of about 0.25 inches to about 3 inches, on at least one of the walls of an outside portion of said inner wall portion or an inside portion of said outer wall portion.

6. The water heater according to claim 5, wherein said first open space has a distance of about 0.0125 inches to about 0.50 inches, when measured along an axis perpendicular to the linings on said inner wall portion or said outer wall portion.

7. The water heater according to claim 2, wherein said third open space region further comprises a quantity of thermal insulation, such that the thermal insulation forms a lining, having a thickness of about 0.25 inches to about 3 inches, on at least one surface of the inside portions of said upper wall portion or said lower wall portion.

8. The water heater according to claim 7, wherein said third open space has a distance of about 0.0125 inches to about 0.50 inches, when measured along an axis perpendicular to the linings of said upper wall portion or said lower wall portion.

9. The water heater of claim 1, wherein a plurality of coil spacers having a multiplicity of circular indents are attached to the thermally conductive coils to maintain even spacing between the coils by fixing coil spacers to the coil.

10. The water heater according to claim 1, wherein the plurality of thermally conductive coils are connected to said water inlet using T-shaped connective joints to split a water volume into at least two coils and connected to said water outlet using T-shaped connective joints to recombine the water volume into a single line.

* * * * *